US007517201B2

(12) United States Patent
Cabuz et al.

(10) Patent No.: US 7,517,201 B2
(45) Date of Patent: Apr. 14, 2009

(54) ASYMMETRIC DUAL DIAPHRAGM PUMP

(75) Inventors: Eugen I. Cabuz, Eden Prairie, MN (US); Tzu-Yu Wang, Maple Grove, MN (US)

(73) Assignee: Honeywell International Inc., Morristown, NJ (US)

( * ) Notice: Subject to any disclaimer, the term of this patent is extended or adjusted under 35 U.S.C. 154(b) by 578 days.

(21) Appl. No.: 11/160,907

(22) Filed: Jul. 14, 2005

(65) Prior Publication Data

US 2007/0014676 A1 Jan. 18, 2007

(51) Int. Cl.
*F04B 17/00* (2006.01)

(52) U.S. Cl. ..... 417/413.2

(58) Field of Classification Search ..... 417/413.3, 417/480, 332, 413.1, 322, 474, 204, 450, 417/413.2, 550, 479, 395; 251/129.01; 92/96, 92/49

See application file for complete search history.

(56) References Cited

U.S. PATENT DOCUMENTS

| | | | | |
|---|---|---|---|---|
| 2,403,692 | A | | 7/1946 | Tibbetts |
| 2,975,307 | A | | 3/1961 | Shroeder et al. |
| 3,304,446 | A | | 2/1967 | Martinek et al. |
| 3,381,623 | A | | 5/1968 | Elliot |
| 3,414,010 | A | | 12/1968 | Sparrow |
| 3,641,373 | A | | 2/1972 | Elkuch |
| 3,769,531 | A | | 10/1973 | Elkuch |
| 3,803,424 | A | | 4/1974 | Smiley et al. |
| 3,838,946 | A | * | 10/1974 | Schall ..... 417/395 |
| 3,947,644 | A | | 3/1976 | Uchikawa |
| 3,993,939 | A | | 11/1976 | Slavin |
| 4,115,036 | A | | 9/1978 | Paterson |
| 4,140,936 | A | | 2/1979 | Bullock |
| 4,197,737 | A | | 4/1980 | Pittman |
| 4,360,955 | A | | 11/1982 | Block |
| 4,381,180 | A | * | 4/1983 | Sell ..... 417/393 |
| 4,418,886 | A | | 12/1983 | Holzer |
| 4,453,169 | A | | 6/1984 | Martner |
| 4,478,076 | A | | 10/1984 | Bohrer |
| 4,478,077 | A | | 10/1984 | Bohrer |
| 4,498,850 | A | * | 2/1985 | Perlov et al. ..... 417/322 |
| 4,501,144 | A | | 2/1985 | Higashi et al. |

(Continued)

FOREIGN PATENT DOCUMENTS

| | | |
|---|---|---|
| DE | 19617852 | 1/1993 |

(Continued)

OTHER PUBLICATIONS

"Large-Scale Linearization Circuit For Electrostatic Motors" IBM Technical Disclosure Bulletin, US. IBM Corp. New York, vol. 37, No. 10, Oct. 1, 1994, pp. 563-564, XP000475777, ISSN: 0018-8689.

(Continued)

*Primary Examiner*—Devon C Kramer
*Assistant Examiner*—Alexander B Comley
(74) *Attorney, Agent, or Firm*—Kris T. Fredrick

(57) ABSTRACT

An asymmetric micro pump may be adapted to provide a greater fluid compression between input and output ports of the micro pump, as well as increased flow rate due to higher actuation frequency. In some instances, asymmetric dual diaphragm micro pumps may be combined into assemblies to provide increased pressure build, improved pumping volume, or both, as desired.

16 Claims, 12 Drawing Sheets

U.S. PATENT DOCUMENTS 4,539,575 A 9/1985 Nilsson
4,576,050 A 3/1986 Lambert
4,581,624 A 4/1986 O'Connor
4,585,209 A 4/1986 Aine et al.
4,619,438 A 10/1986 Coffee
4,651,564 A 3/1987 Johnson et al.
4,654,546 A 3/1987 Kirjavainen
4,697,989 A * 10/1987 Perlov et al. ..... 417/53
4,722,360 A 2/1988 Odajima et al.
4,756,508 A 7/1988 Giachino et al.
4,821,999 A 4/1989 Ohtaka
4,829,826 A 5/1989 Valentin et al.
4,898,200 A 2/1990 Odajima et al.
4,911,616 A 3/1990 Laumann, Jr.
4,938,742 A 7/1990 Smits
4,939,405 A 7/1990 Okuyama et al.
5,065,978 A 11/1991 Albarda et al.
5,069,419 A 12/1991 Jerman
5,078,581 A 1/1992 Blum et al.
5,082,242 A 1/1992 Bonne et al.
5,085,562 A 2/1992 van Lintel
5,096,388 A 3/1992 Weinberg
5,129,794 A 7/1992 Beatty
5,148,074 A 9/1992 Fujita et al.
5,171,132 A 12/1992 Miyazaki et al.
5,176,358 A 1/1993 Bonne et al.
5,180,288 A 1/1993 Richter et al.
5,180,623 A 1/1993 Ohnstein
5,186,054 A 2/1993 Sekimura
5,192,197 A 3/1993 Culp
5,206,557 A 4/1993 Bobbio
5,219,278 A 6/1993 van Lintel
5,224,843 A 7/1993 van Lintel
5,244,527 A 9/1993 Aoyagi
5,244,537 A 9/1993 Ohnstein
5,322,258 A 6/1994 Bosch et al.
5,323,999 A 6/1994 Bonne et al.
5,325,880 A 7/1994 Johnson et al.
5,333,831 A * 8/1994 Barth et al. ..... 251/11
5,336,062 A 8/1994 Richter
5,368,571 A 11/1994 Horres, Jr.
5,380,396 A * 1/1995 Shikida et al. ..... 216/2
5,441,597 A 8/1995 Bonne et al.
5,452,878 A 9/1995 Gravesen et al.
5,499,909 A 3/1996 Yamada et al.
5,526,172 A 6/1996 Kanack
5,529,465 A * 6/1996 Zengerle et al. ..... 417/413.2
5,536,963 A 7/1996 Polla
5,541,465 A 7/1996 Higuchi et al.
5,542,821 A 8/1996 Dugan
5,552,654 A 9/1996 Konno et al.
5,571,401 A 11/1996 Lewis et al.
5,642,015 A 6/1997 Whitehead et al.
5,671,905 A * 9/1997 Hopkins, Jr. ..... 251/129.01
5,683,159 A 11/1997 Johnson
5,696,662 A 12/1997 Bauhahn
5,725,363 A 3/1998 Bustgens et al.
5,759,014 A 6/1998 Van Lintel
5,759,015 A 6/1998 Van Lintel et al.
5,792,957 A 8/1998 Luder et al.
5,808,205 A 9/1998 Romo
5,822,170 A 10/1998 Cabuz
5,836,750 A 11/1998 Cabuz
5,839,467 A 11/1998 Saaski et al.
5,863,708 A 1/1999 Zanzucchi et al.
5,872,627 A 2/1999 Miers
5,901,939 A 5/1999 Cabuz et al.
5,911,872 A 6/1999 Lewis et al.
5,954,079 A 9/1999 Barth et al.
5,971,355 A 10/1999 Biegelsen et al.
6,106,245 A * 8/2000 Cabuz ..... 417/322
6,109,889 A 8/2000 Zengerie et al.
6,116,863 A 9/2000 Ahn et al.
6,122,973 A 9/2000 Nomura et al.
6,151,967 A 11/2000 McIntosh et al.
6,167,761 B1 1/2001 Hanzawa et al.
6,168,395 B1 * 1/2001 Quenzer et al. ..... 417/413.3
6,179,586 B1 1/2001 Herb et al.
6,179,856 B1 1/2001 Barbere
6,182,941 B1 2/2001 Scheurenbrand et al.
6,184,607 B1 2/2001 Cabuz et al.
6,184,608 B1 2/2001 Cabuz et al.
6,211,580 B1 4/2001 Cabuz et al.
6,215,221 B1 4/2001 Cabuz et al.
6,227,809 B1 * 5/2001 Forster et al. ..... 417/53
6,240,944 B1 6/2001 Ohnstein et al.
6,255,758 B1 7/2001 Cabuz et al.
6,288,472 B1 9/2001 Cabuz et al.
6,358,021 B1 3/2002 Cabuz
6,373,682 B1 4/2002 Goodwin-Johansson
6,432,721 B1 8/2002 Zook et al.
6,445,053 B1 9/2002 Cho
6,450,773 B1 9/2002 Upton
6,496,348 B2 12/2002 McIntosh
6,508,528 B2 1/2003 Fujii et al.
6,520,753 B1 2/2003 Grosjean et al.
6,549,275 B1 4/2003 Cabuz et al.
6,568,286 B1 5/2003 Cabuz
6,579,068 B2 6/2003 Bridger et al.
6,590,267 B1 7/2003 Goodwin-Johansson et al.
6,597,438 B1 7/2003 Cabuz et al.
6,640,642 B1 11/2003 Onose et al.
6,644,117 B1 11/2003 Kueck et al.
6,649,416 B1 11/2003 Kauer et al.
6,651,506 B2 11/2003 Lee et al.
6,655,923 B1 * 12/2003 Lisec et al. ..... 417/92
6,729,856 B2 5/2004 Cabuz et al.
6,750,589 B2 6/2004 Cabuz
6,758,107 B2 7/2004 Cabuz
6,767,190 B2 7/2004 Cabuz et al.
6,837,476 B2 1/2005 Cabuz et al.
6,889,567 B2 * 5/2005 Cabuz ..... 73/863.23
6,991,213 B2 * 1/2006 Wang et al. ..... 251/129.01
7,168,675 B2 * 1/2007 Cabuz et al. ..... 251/7
2001/0028854 A1 * 10/2001 Igenhoven et al. ..... 417/413.1
2002/0067992 A1 * 6/2002 Bridger et al. ..... 417/53
2002/0078756 A1 6/2002 Akiyama et al.
2002/0174706 A1 11/2002 Gokhfeld
2002/0192113 A1 12/2002 Uffenheimer et al.
2003/0005774 A1 1/2003 Suzuki et al.
2003/0019299 A1 1/2003 Horie et al.
2003/0033884 A1 2/2003 Beekhuizen et al.
2003/0142291 A1 7/2003 Padmanabhan et al.
2003/0189809 A1 10/2003 Ishikura
2003/0205090 A1 11/2003 Jakobsen
2003/0234376 A1 12/2003 Cabuz et al.
2004/0035211 A1 2/2004 Pinto et al.
2004/0060360 A1 4/2004 Chen
2005/0062001 A1 3/2005 Cabuz et al.
2005/0175478 A1 * 8/2005 Marr et al. ..... 417/410.1
2007/0014676 A1 * 1/2007 Cabuz et al. ..... 417/413.3

FOREIGN PATENT DOCUMENTS

EP 0744821 11/1996
JP 05-219760 8/1993
JP 02-86258 10/1995
SU 744877 6/1980
WO WO 97/29538 8/1997
WO WO 00/28215 5/2000

WO WO 01/33078 10/2001

OTHER PUBLICATIONS

Athavale et al., "Coupled Electrostatics-Structures-Fluidic Simulations of A Bead Mesopump," Proceedings of the International Mechanical Engineers Congress & Exhibition, Nashville, Tennessee, Oct. 1999.

B. Halg, "On a Nonvolatile Memory Cell Based on Micro-Electro-Mechanics", Proceedings of MEMS CH2832-4/90/0000-0172 IEEE (1990), pp. 172-176.

Bertz, Schubert, Werner, "Silicon Grooves With Sidewall Angles Down to 1° made By Dry Etching", pp. 331-339.

Bonne et al. "Actuation-Based Fuel Gas Microsensors", IGT Symposium on "Natural Gas Quality, Energy Measurement, Metering and Utilization Practices", Orlando, FL, 17 pages, Mar. 2001.

Branebjerg, Gravesen , "A New Electrostatic Actuator Providing Improved Stroke Length and Force." Micro Elctro Mechanical Systems '92 (Feb. 4-7, 1992), pp. 6-11.

Bustgens, Bacher, Menz, Schomburg, "Micropump Manufactured by Thermoplastic Molding" MEMS 1994, pp. 18-21.

C. Cabuz et al., "Factors Enhancing the Reliability of Touch-Mode Electrostatic Actuators," Sensors and Actuators 79, pp. 245-250, 2000.

C. Cabuz et al., "Mesoscopic Sampler Based on 3D Array of Electrostatically Activated Diaphragms," Proceedings of the 10th Int. Conf. On Solid-State Sensors and Actuators, Transducers'99, Jun. 7-12, 1999, Sendai Japan.

C. Cabuz et al., "The Double Diaphragm Pump," The 14th IEEE International Micro Electro Mechanical Systems conference, MEMS'01, Jan. 21-23, Interlachen, Switzerland.

C. Cabuz, et al., "High Reliability Touch-Mode Electrostatic Actuators", Technical Digest of the Solid State Sensor and Actuator Workshop, Hilton Head, S.C., Jun. 8-11, 1998, pp. 296-299.

C. Cabuz. Tradeoffs in MEMS Material (Invited Paper) Proceedings of the SPIE, vol. 2881, pp. 160-170, Austin, TX., Jul. 1996.

Cabuz, Cleopatra, "Electrical Phenomena at the Interface of Rolling-Contact, Electrostatic Actuators", Nanotribology: Critical Assessment and Research Needs, Kluwer Academic Publisher, pp. 221-236, Copyright 2003, presented at the Nanotribology Workshop, Mar. 13-15, 2000.

Cleo Cabuz, "Dielectric Related Effects in Micromachined Electrostatic Actuators," Annual Report of the IEEE/CEIDP Society, 1999, Annual Meeting, Austin, Texas, Oct. 17-20, 1999.

Jye-Shane Yang et al., "Fluorescent Porous Polymer Films as TNT Chemosensors: Electronic and Structural Effects", *J. Am. Chem. Soc.*, 1998, 120, pp. 11864-11873.

Jye-Shane Yang et al., "Porous Shape Persistent Fluorescent Polymer Films: An Approach to TNT Sensory Materials", *J. Am. Chem. Soc.*, 1998, 120, pp. 5321-5322.

Michael S. Freund et al., "A Chemically Diverse Conducting Polymer-Based 'Electronic Nose'", Proceedings of the National Academy of Sciences of the United States of America, vol. 92, No. 7, Mar. 28, 1995, pp. 2652-2656.

Minami K et al., "Fabrication of Distributed Electrostatic Micro Actuator (DEMA)" Journal of Microelectromechanical Systems, US, IEEE Inc., New York, vol. 2, No. 3, Sep. 1, 1993, pp. 121-127, XP000426532, ISSN: 1057-7157

Ohnstein et al., "Micromachined Silicon Microvalve", Micro Electromechanical Systems Workshop, Salt Lake City, UT, 4 pages, Feb. 20-22, 1990.

Porex Technologies, brochure, dated prior to Jun. 2, 2000, 4 pages.

Shikida, Sato, "Characteristics of an Electrostatically-Driven Gas Valve Under High Pressure Conditions, IEEE 1994, pp. 235-240."

Shikida, Sato, Harada, "Fabrication of an S-Shaped Microactuator," Journal of Microelectromechanical Systems, vol. 6, No. 1 (Mar. 1997), pp. 18-24.

Shikida, Sato, Tanaka, Kawamura, Fujisaki, "Electrostatically Driven Gas Valve With High Conductance", Journal of Microelectromechanical Systems, vol. 3, No. 2 (Jun. 1994), pp. 76-80.

Srinivasan et al., "Self-Assembled Fluorocarbon Films for Enhanced Stiction Reduction", Transducers '97, 1997 International Conference on Solid-State Sensors and Actuators, Chicago, Jun. 16-19, 1997, pp. 1399-1402.

Wagner, Quenzer, Hoerscelmann, Lisec, Juerss, "Bistable Microvalve with Pneumatically Coupled Membranes," 0-7803-2985-6/96, IEEE (1996), pp. 384-388.

* cited by examiner

ASYMMETRIC DUAL DIAPHRAGM PUMP

TECHNICAL FIELD

The present invention relates generally to pumps, and more particularly to dual diaphragm pumps.

BACKGROUND

Modern consumer, industrial, commercial, aerospace and military systems often depend on reliable pumps for fluid handling. For some applications, such as in some instrumentation, sensing and/or control applications, smaller pump systems are often desirable. Although some important advances have been made in micro pump technology, a need still remains for micro pumps that have improved performance characteristics.

SUMMARY

The present invention generally relates to pumps, and more particularly to dual diaphragm pumps. In some cases, the present invention may provide greater fluid compression between input and output ports of the pump, as well as increased flow rate due to higher actuation frequency, if desired.

In one illustrative embodiment of the present invention, a micro pump is provided that includes a pump chamber having a chamber midline, a first surface and a second surface. The first surface includes a first portion that extends at a first acute angle with respect to the chamber midline. The second surface includes a second portion that extends at a second acute angle with respect to the chamber midline. In some cases, the second angle is less than the first angle, and in some cases may be zero or even negative. The micro pump may include a first diaphragm and a second diaphragm disposed within the chamber. The first diaphragm and the second diaphragm may each have at least one aperture disposed therein.

In some instances, the first diaphragm is adapted to be electrostatically actuated toward the first surface and/or the second surface, and the second diaphragm is adapted to be electrostatically actuated toward the second surface and/or the first surface. In some cases, the first diaphragm and the second diaphragm are adapted to return to a position proximate the chamber midline by elastic restoring forces, but this is not required in all embodiments. At least one aperture disposed within the first diaphragm may be misaligned with the at least one aperture disposed within the second diaphragm when the first and second diaphragms are positioned proximate to one another.

In some cases, the first surface can include a first port. The first diaphragm may be adapted to be electrostatically actuated to a position adjacent to the first surface to seal or substantially seal the first port. Likewise, the second surface can include a second port, and the second diaphragm may be adapted to be electrostatically actuated to a position adjacent the second surface to seal or substantially seal the second port.

In some instances, the first diaphragm and the second diaphragm are adapted so that they may be independently electrostatically actuated. For example, the first diaphragm may be adapted such that it can be independently electrostatically actuated to a position adjacent the first surface, so that the first diaphragm seals or substantially seals the first port, or adjacent the second surface. Likewise, the second diaphragm may be adapted such that it can be independently electrostatically actuated into a position adjacent the second surface so that the second diaphragm seals or substantially seals the second port, or adjacent the first surface. In some cases, vertical and/or horizontal stacks of such micro pumps may be provided to increase pumping compression or capacity, and in some cases, improve reliability, as desired.

The above summary of the present invention is not intended to describe each disclosed embodiment or every implementation of the present invention. The Figures, Detailed Description and Examples which follow more particularly exemplify these embodiments.

BRIEF DESCRIPTION OF THE FIGURES

The invention may be more completely understood in consideration of the following detailed description of various embodiments of the invention in connection with the accompanying drawings, in which.

Figure 1:
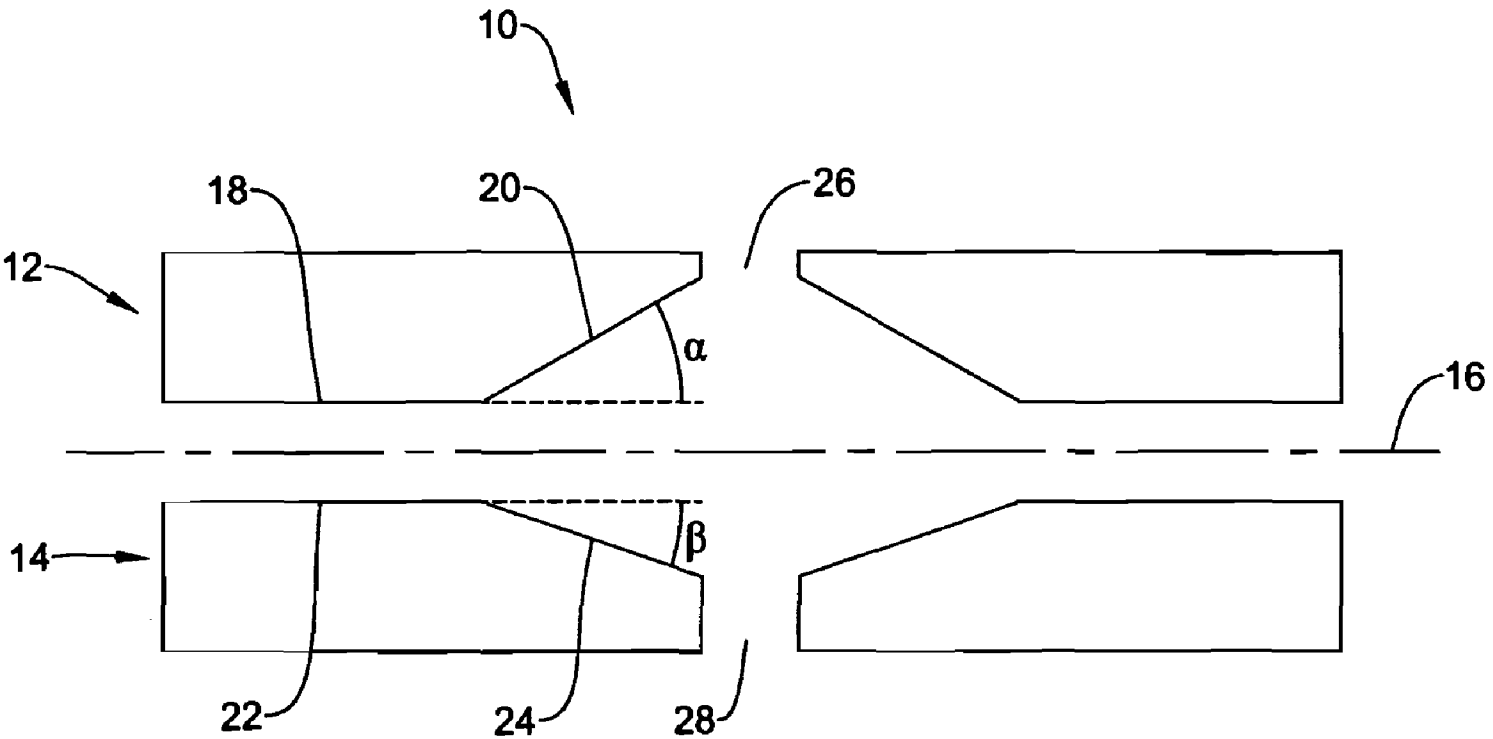
FIG. 1 is an exploded cross-sectional view of a micro pump chamber in accordance with an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 is an exploded view of a micro pump chamber 10 that includes an upper section 12 and a lower section 14. In the description that follows, the designations of upper and lower are arbitrary, and are made merely for ease of discussion. In some instances, micro pump chamber 10 may be circular in shape if viewed from above or below. Other shapes are of course contemplated as well.

A chamber midline 16 can be seen as extending between upper section 12 and lower section 14. The term "chamber midline" is not intended to imply that it extends exactly in the middle of the chambers, but rather that it simply divides the chamber into two parts. It should be noted that the spacing between elements in FIG. 1 has been greatly exaggerated for clarity. When upper section 12 and lower section 14 are positioned next to each other, and in the illustrative embodiment shown in FIG. 1, it can be seen that chamber midline 16 will intersect the junction between upper section 12 and lower section 14.

Upper section 12 has a surface 18 that includes a portion 20 that forms an acute angle $\alpha$ with chamber midline 16. Similarly, lower section 14 has a surface 22 that includes a portion 24 that forms an angle $\beta$ with chamber midline 16. In some instances, angle $\beta$ may be less than angle $\alpha$. In some cases, angle $\beta$ may be at least about 0.25 degrees less than angle $\alpha$.

Angle $\alpha$ may be as large as desired to accomplish desired pumping characteristics and may be as large as about 45 degrees. In some particular instances, angle $\alpha$ may be, for example, in the range of about 0.5 degrees to about 5.0 degrees, while angle $\beta$ may be in the range of about 0 to about 4.75 degrees. In some instances, angle $\beta$ may be less than about 2.0 degrees and in some cases, and as illustrated with respect to FIG. 3, may be equal to about zero, or even negative if desired.

It can be noted that setting angle $\beta$ to be less than angle $\alpha$ can reduce the working volume of, or the total space within micro pump chamber 10 (i.e. between upper section 12 and lower section 14). However, in some instances, reducing angle $\beta$ with respect to angle $\alpha$ can provide improvements in some performance parameters. For example, by reducing angle $\beta$ with respect to angle $\alpha$, pumping frequency may be increased. Alternatively, or in addition, reducing angle $\beta$ with respect to angle $\alpha$ may help increase the pressure differential that can be achieved across micro pump chamber 10.

In the illustrative embodiment, upper section 12 includes a port 26 while lower section 14 includes a port 28. It should be noted that while micro pump chamber 10 is not symmetric with respect to opposing sides of chamber midline 16 (i.e. upper section 12 is not symmetric to lower section 14), micro pump chamber 10 can in some embodiments be symmetric in the left-right direction. In other words, in the illustrative embodiment of FIG. 1, the right hand portion of upper section 12 (without reference numbers) may be a mirror image of the left hand portion of upper section 12 (with reference numbers), but this is not required. Similarly, right hand portion of lower section 14 may be a mirror image of the left hand portion of lower section 14, but this is also not required.

In some instances, micro pump chamber 10 including upper section 12 and lower section 14 may be formed from any suitable semi-rigid or rigid material, such as plastic, ceramic, silicon, etc. For example, and in some embodiments, micro pump chamber 10 may be constructed by molding a high temperature plastic such as ULTEM™ (available from General Electric Company, Pittsfield, Mass.), CELAZOLE™ (available from Hoechst-Celanese Corporation, Summit, N.J.), KETRON™ (available from Polymer Corporation, Reading, Pa.), or some other suitable material.

Figure 2:
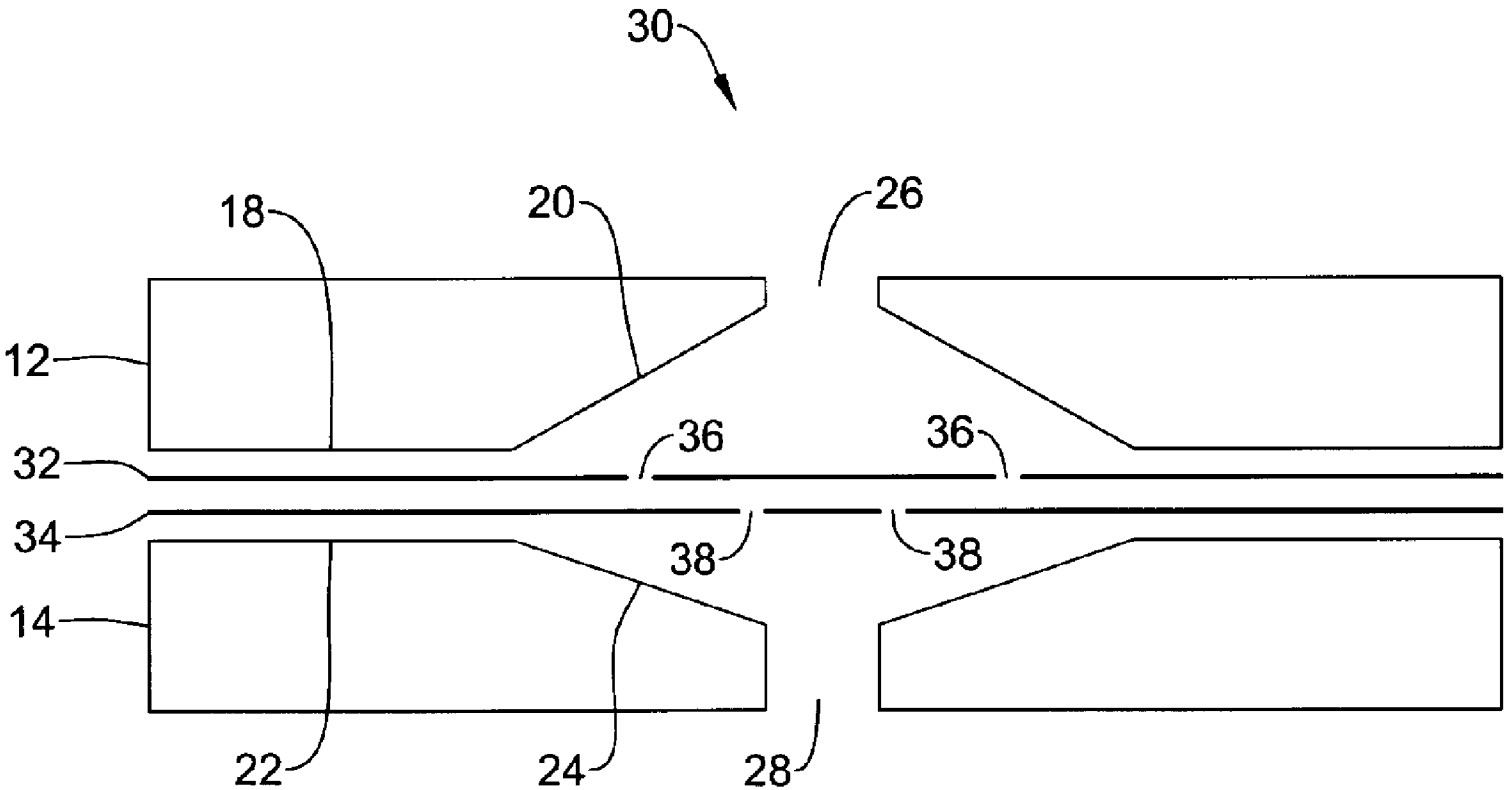
FIG. 2 is an exploded cross-sectional view of an asymmetric dual diaphragm micro pump in accordance with an embodiment of the present invention.

FIG. 2 is an exploded view of a micro pump 30 employing micro pump chamber 10 (FIG. 1). Chamber midline 16 (FIG. 1) has been excised from this Figure to better illustrate an upper diaphragm 32 and a lower diaphragm 34. In the illustrative embodiment, upper diaphragm 32 includes one or more upper apertures 36 and lower diaphragm 34 includes one or more lower apertures 38. As can be seen in FIG. 2, upper apertures 36 may be laterally offset from lower apertures 38.

In some instances, upper apertures 36 may be aligned within upper diaphragm 32 about a circle of a first radius while lower apertures 38 may be aligned within lower diaphragm 34 about a circle of a second radius that is different from the first radius, with both radii having a common center point. In this configuration, the upper apertures 36 are misaligned with the lower apertures 38, and when the upper diaphragm 32 and the lower diaphragm 34 are situated directly adjacent to one another (e.g. in contact), the upper diaphragm 32 may seal or substantially seal the lower apertures 38 and the lower diaphragm 34 may seal or substantially seal the upper apertures 36.

In some instances, the material used to make the upper diaphragm 32 and the lower diaphragm 34 may have elastic, resilient, flexible or other elastomeric properties, but this is not required in all embodiments. In some cases, upper diaphragm 32 and lower diaphragm 34 may be made from a generally compliant material. For example, upper diaphragm 32 and lower diaphragm 34 may be made from a polymer such as KAPTON™ (available from E.I. du Pont de Nemours & Co., Wilmington, Del.), KALADEX™ (available from ICI Films, Wilmington, Del.), MYLAR™ (available from E.I. du Pont de Nemours & Co., Wilmington, Del.), ULTEM™ (available from General Electric Company, Pittsfield, Mass.) or any other suitable material as desired.

As will be discussed in greater detail with respect to FIGS. 4 through 9, upper diaphragm 32 and lower diaphragm 34 may be electrostatically actuated through a variety of positions. Upper diaphragm 32 can be electrostatically actuated to a position in which the upper diaphragm is disposed next to surface 18 such that the upper diaphragm seals or substantially seals port 26. Likewise, the lower diaphragm 34 can be electrostatically actuated to a position in which lower diaphragm 34 is disposed next to surface 22 such that the lower diaphragm seals or substantially seals port 28. In some cases, the upper diaphragm 32 and the lower diaphragm 34 may be independently electrostatically actuated. For example, the upper diaphragm 32 and the lower diaphragm 34 may move in opposite directions and/or in unison. In some cases, one of the upper diaphragm 32 or lower diaphragm 34 may be electrostatically moved while the other remains stationary.

In order to provide for electrostatic actuation of upper diaphragm 32 and lower diaphragm 34, it will be recognized that upper diaphragm 32, lower diaphragm 34, surface 18 and surface 22 may each include a corresponding electrode. Electrodes may be formed of any suitable material, using any suitable technique. By applying voltages between appropriate electrodes, upper diaphragm 32 and lower diaphragm 34 may be moved as desired via electrostatic forces. In some instances, each of the electrodes (not illustrated) may include one or more dielectric layers, either under or above each electrode, to help prevent electrical shorts between the electrodes, particularly when the corresponding components engage one another.

Figure 3:
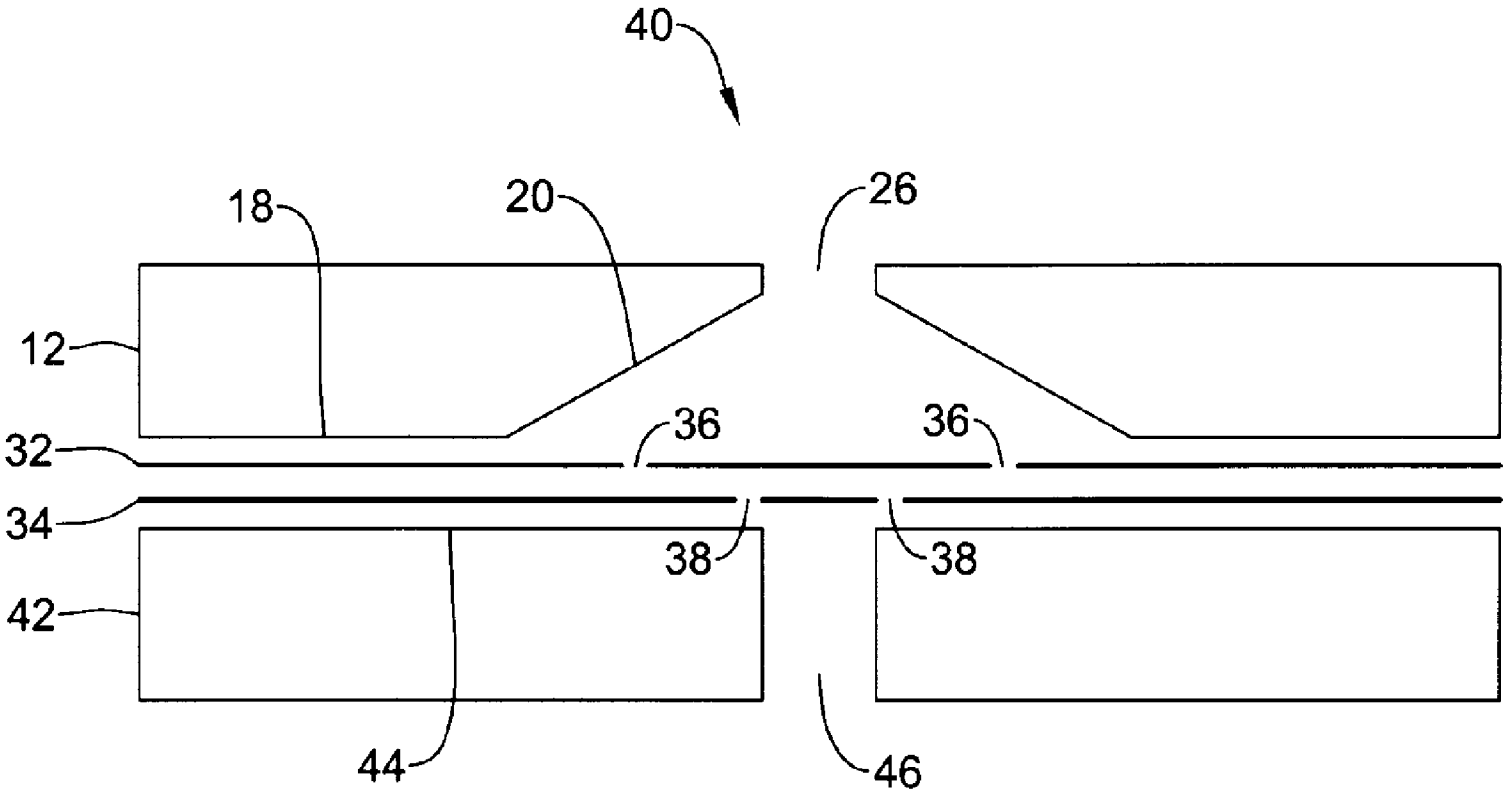
FIG. 3 is an exploded cross-sectional view of an asymmetric dual diaphragm micro pump in accordance with an embodiment of the present invention.

FIG. 3 is an exploded view of a micro pump 40 including upper section 12 as discussed with respect to FIG. 2 and a lower section 42. Upper diaphragm 32 and lower diaphragm 34 function and are constructed as discussed previously. In this illustrative embodiment, angle $\beta$ is shown to be about zero degrees, and thus lower section 42 includes a surface 44 that is disposed at least substantially parallel with chamber midline 16 (FIG. 1). In some cases, the lower diaphragm 34 may not need to be electrostatically pulled down toward surface 44, as elastic restoring forces may provide this function.

However, in some embodiments, the lower diaphragm 34 is electrostatically pulled down toward surface 44.

FIGS. 4 through 9 are diagrammatic cross-sections showing an illustrative pumping cycle employing micro pump 30 (FIG. 2). In particular, these Figures illustrate a pumping sequence where the inlet is on the bottom, and the outlet is on the top. An opposite configuration is equally appropriate since the illustrative micro pump may be completely reversible. As referenced previously, and in some illustrative embodiments, upper diaphragm 32 and lower diaphragm 34 may be electrostatically actuated between various positions. As they move, upper diaphragm 32 and lower diaphragm 34 may be considered as defining an upper volume 48, a lower volume 50 and a middle volume 52.

It should be noted that the spacing between individual components has been exaggerated for clarity in FIGS. 4 through 9. In many cases, upper diaphragm 32 and lower diaphragm 34 would actually be in physical contact when moving in unison, as shown, for example, in FIGS. 4, 5 and 6.

Upper volume 48 is formed between portion 20 of surface 18 and upper diaphragm 32, lower volume 50 is formed between lower diaphragm 34 and portion 24 of surface 22, and middle volume 52 is formed between upper diaphragm 32 and lower diaphragm 34. It will be recognized that at particular pumping cycle stages, one or more of upper volume 48, lower volume 50 and middle volume 52 may essentially disappear (i.e. become zero or substantially zero), depending on the relative positions of upper diaphragm 32 and lower diaphragm 34.

Figure 4:
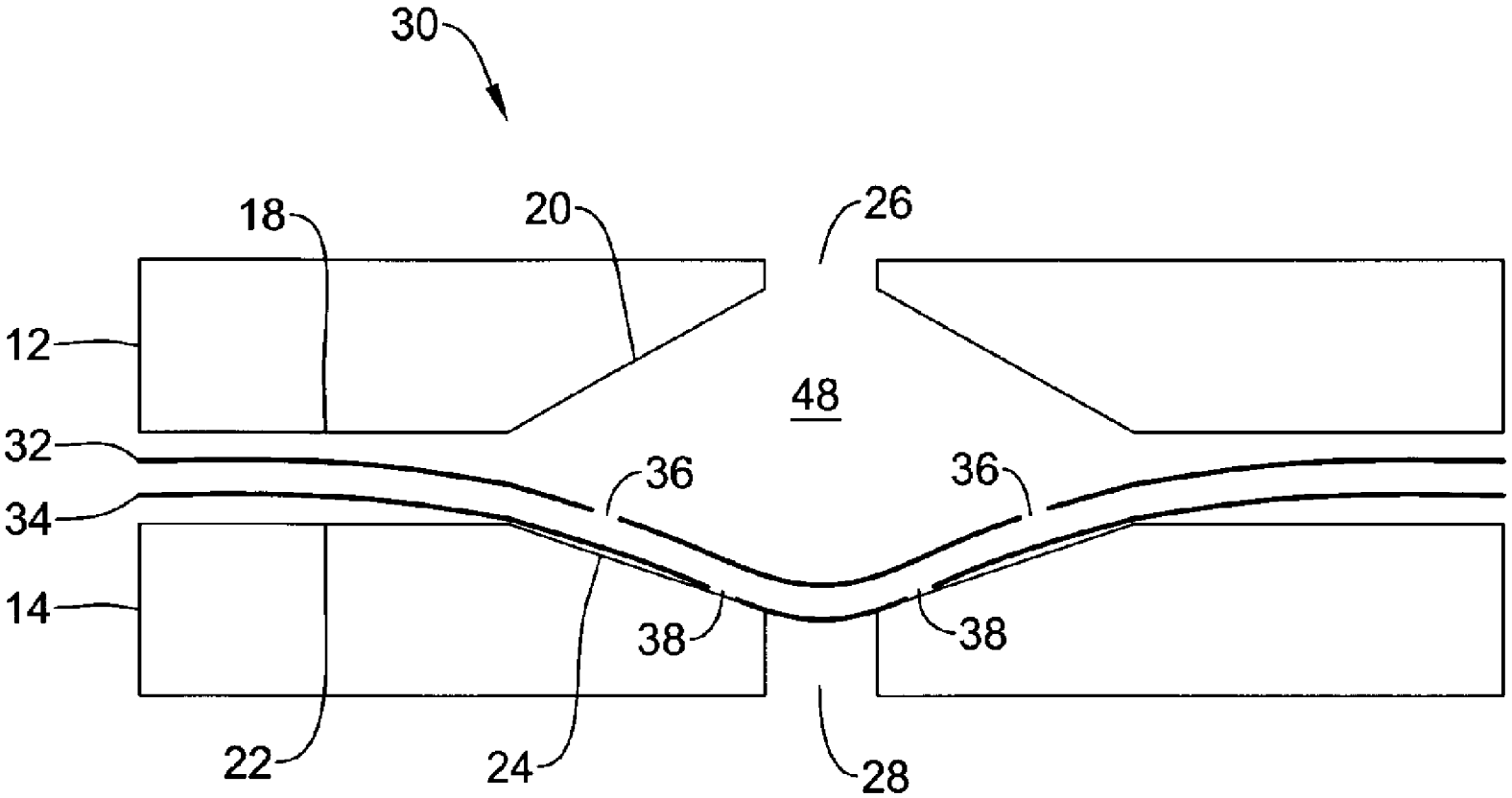
FIGS. 4 through 9 schematically illustrate operation of the micro pump of FIG. 2.

In FIG. 4, upper diaphragm 32 and lower diaphragm 34 have both been electrostatically pulled down, thereby sealing port 28. At this point, fluid (e.g. gas or liquid) is assumed to be contained within upper volume 48, while lower volume 50 and middle volume 52 are essentially eliminated by the position of upper diaphragm 32 and lower diaphragm 34. As can be seen, upper apertures 36 and lower apertures 38 do not align with each other or with either of port 26 or port 28, in order to affect desired seals during each cycle.

Figure 5:
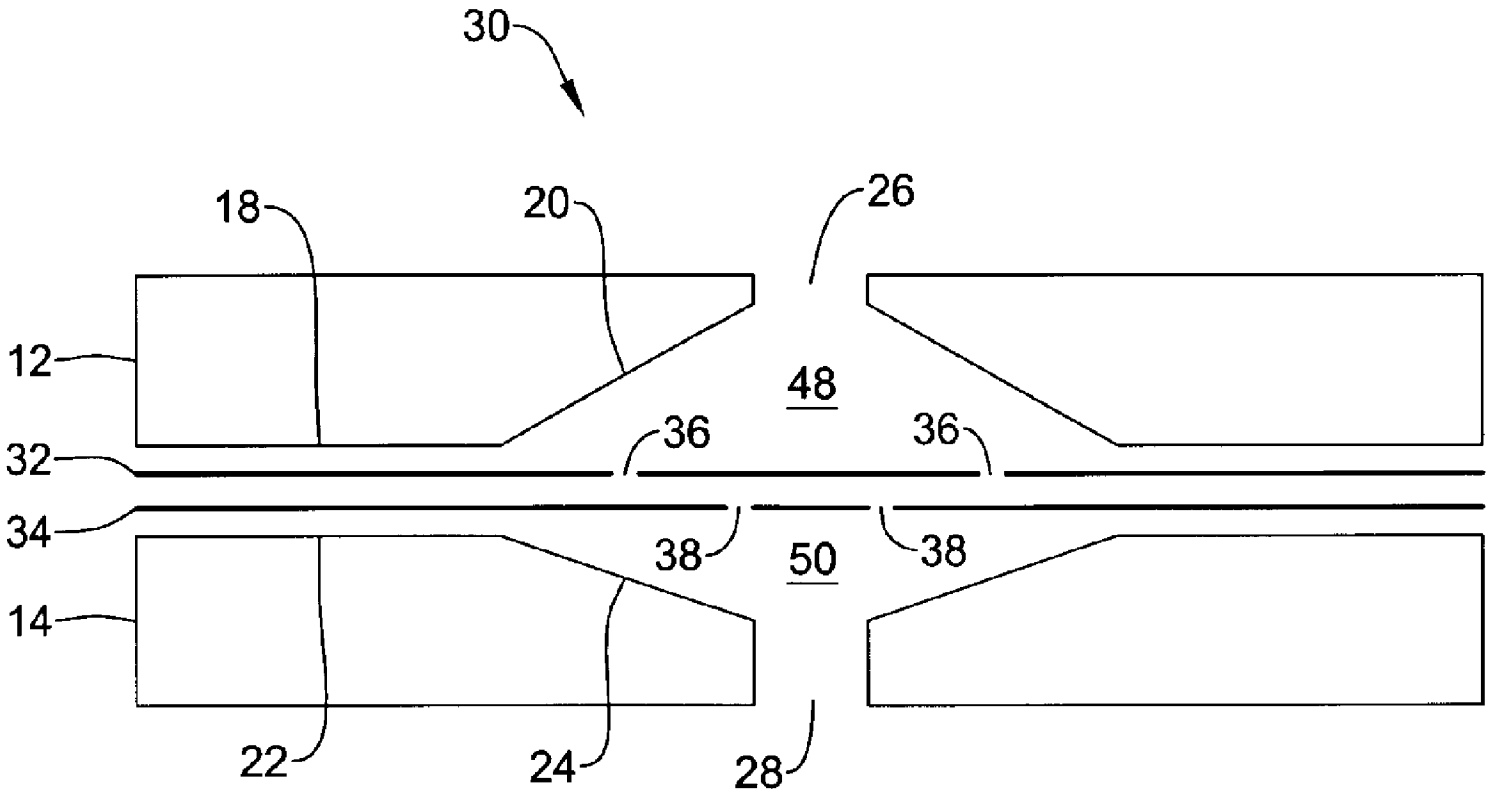
Figure 6:
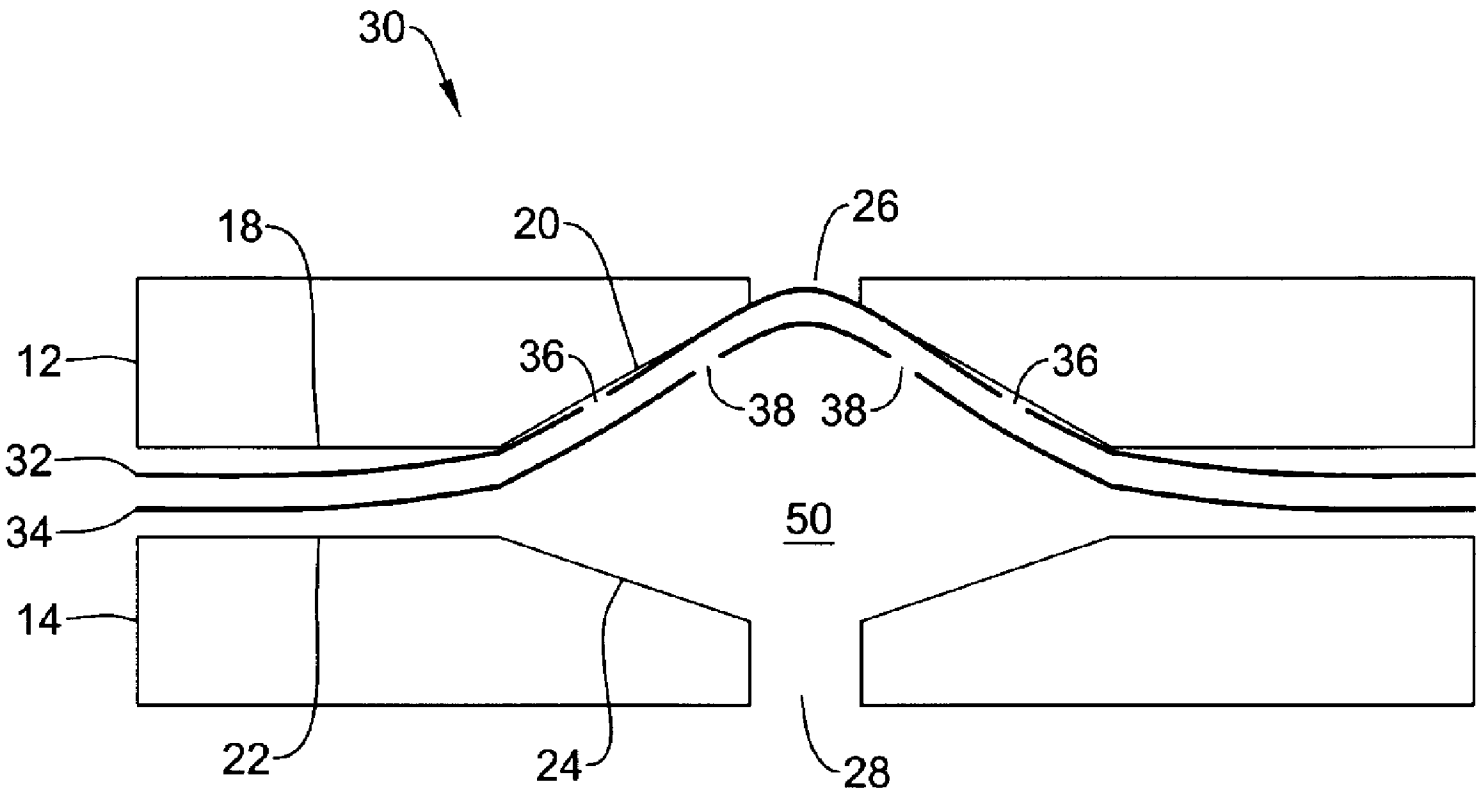

FIG. 5 illustrates initiation of the pump stroke by simultaneously electrostatically pulling upper diaphragm 32 and lower diaphragm 34 towards the top, thus pushing the fluid that is contained within upper volume 48 through port 26. In the illustrative embodiment, this may be accomplished by providing appropriate voltages between the electrodes on portion 20 of surface 18 and the upper diaphragm 32 and/or lower diaphragm 34. In some cases, elastic restoring forces may supplement the movement of the upper diaphragm 32 and lower diaphragm 34 to the position shown in FIG. 5, or may be used exclusively. FIG. 6 illustrates completion of this pump stroke, with both upper diaphragm 32 and lower diaphragm 34 electrostatically pulled up to seal port 26. At this point, all of the fluid that was in upper volume 48 has been pushed out and expelled through port 26. During this same stroke new fluid is drawn in to lower volume 50 via port 28.

Figure 7:
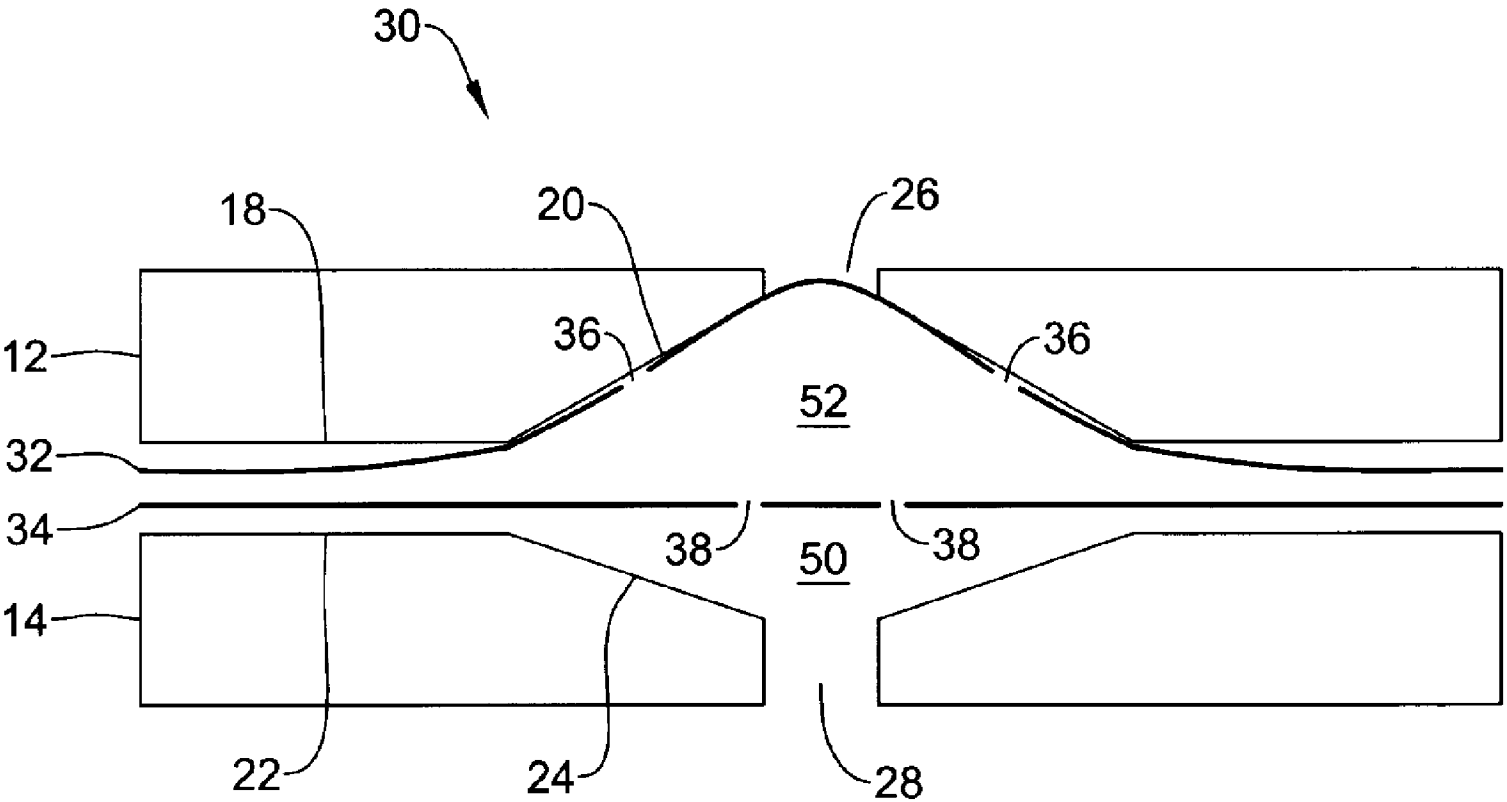
Figure 8:
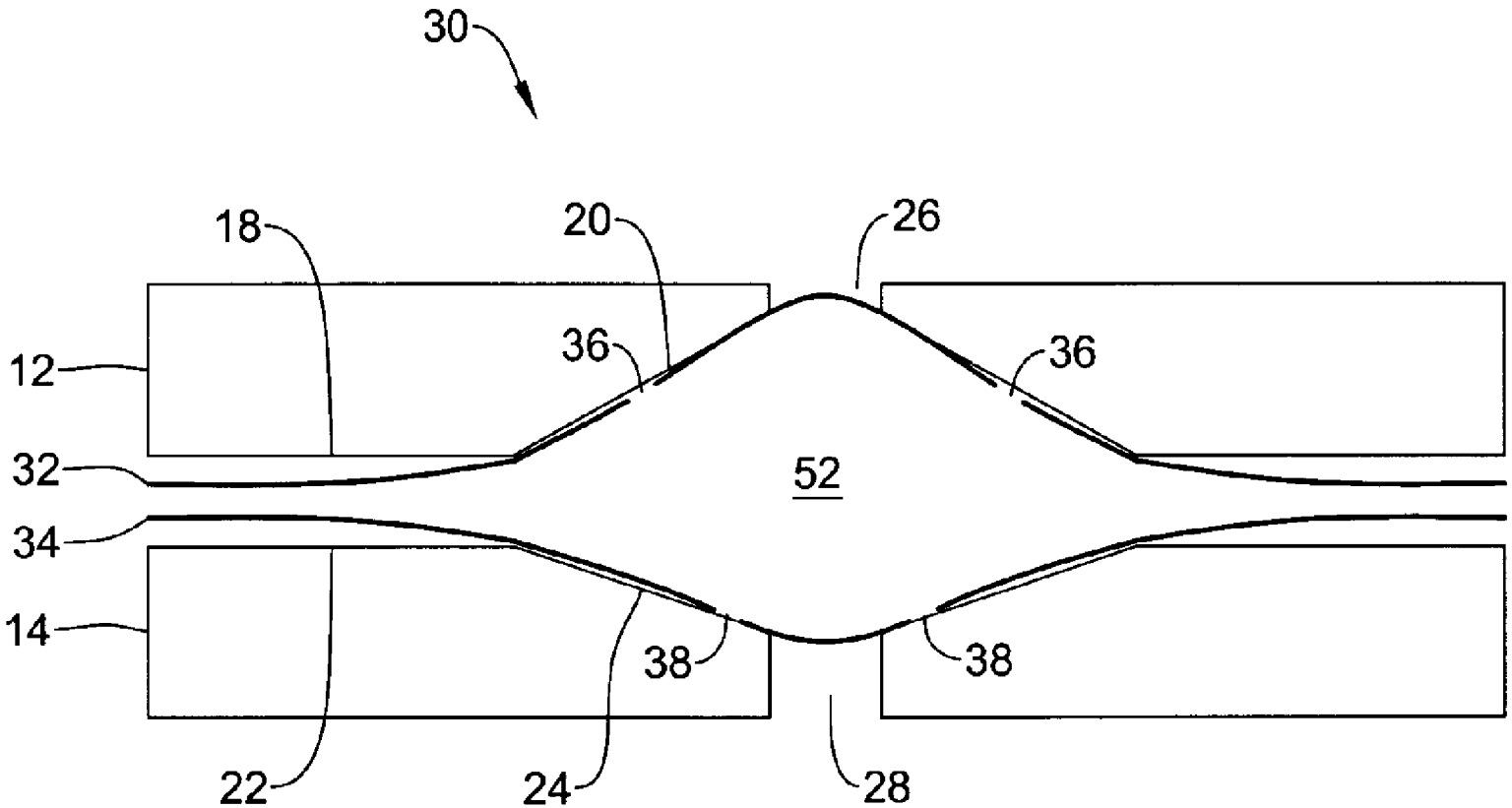
Figure 9:
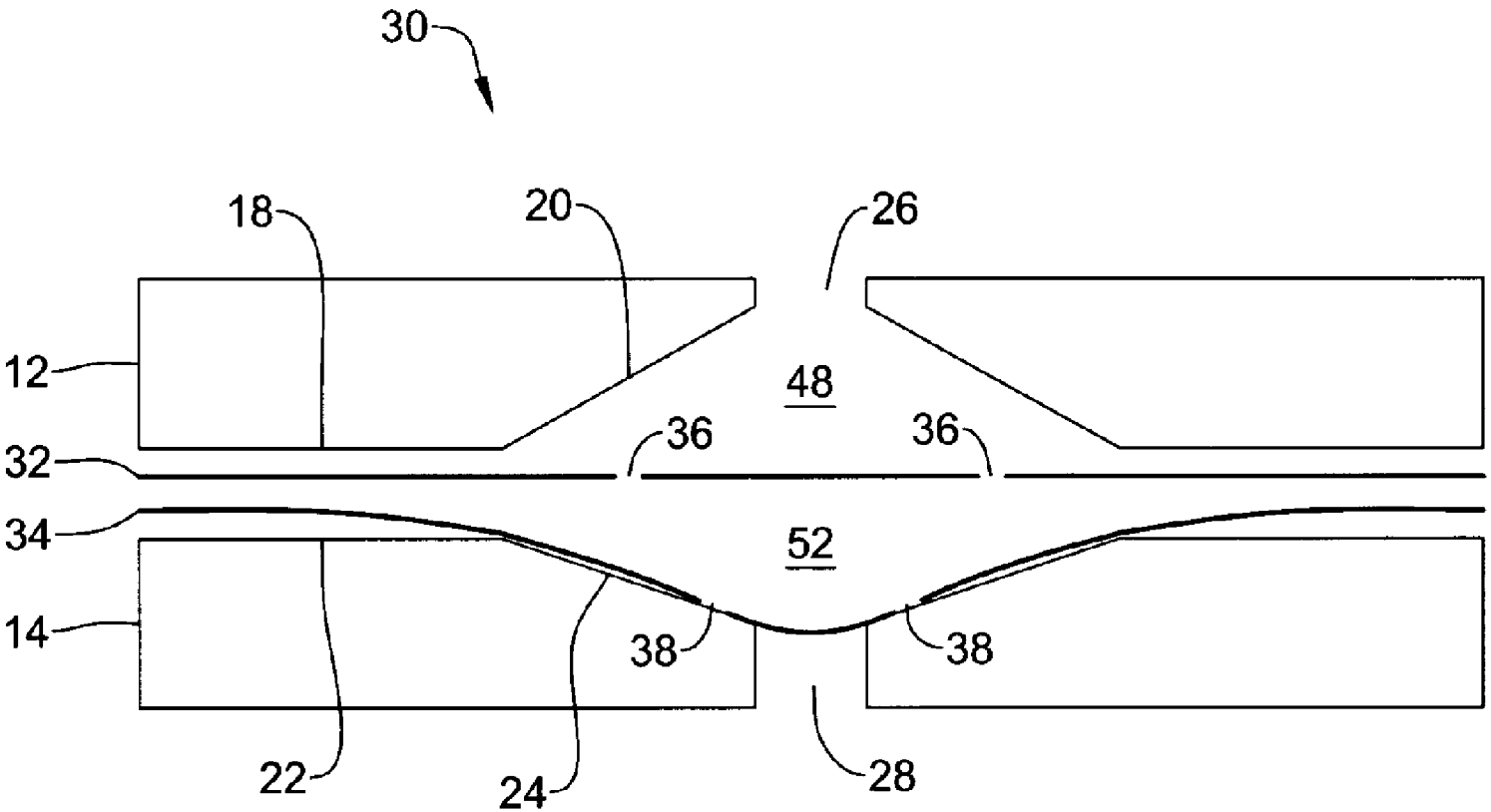

In FIG. 7, upper diaphragm 32 remains in sealing relationship with port 26 while lower diaphragm 34 is electrostatically and/or elastically pulled down, thereby causing the fluid in lower volume 50 to transfer into middle chamber 52 via lower apertures 38 (FIG. 2) within lower diaphragm 34. FIG. 8 illustrates the orientation of lower diaphragm 34 completely pulled down electrostatically to seal port 28 while upper diaphragm 32 remains in position sealing port 26. Finally, FIG. 9 illustrates the midpoint of movement of upper diaphragm 32 down toward lower diaphragm 34, wherein fluid may be pulled from middle volume 52 into upper volume 48. Eventually, the upper diaphragm 32 is pulled down until it is adjacent to the lower diaphragm 34, as shown in FIG. 4, thus completing the pump cycle. The above-described pumping cycle may be repeated to pump more fluid from port 28 to port 26.

In some illustrative embodiments, micro pumps such as micro pump 30 or micro pump 40 may be assembled into micro pump arrays. By arranging micro pumps 30 or micro pumps 40 in series, i.e. the output of a first micro pump 30 or micro pump 40 may be provided to an input of a second micro pump 30 or micro pump 40. This may create a greater pressure build-up across the micro pump assembly. By arranging micro pumps 30 or micro pumps 40 in parallel, greater pumping volume may be achieved. In some instances, two or more micro pumps 30 or micro pumps 40 may be arranged in series, and a number of the series of micro pumps 30 or micro pumps 40 may then be arranged in parallel to provide a two dimensional pumping array that provides both an improved pressure differential as well as greater pumping volume. FIGS. 10 through 14 show particular examples of some illustrative micro pump arrays.

Figure 10:
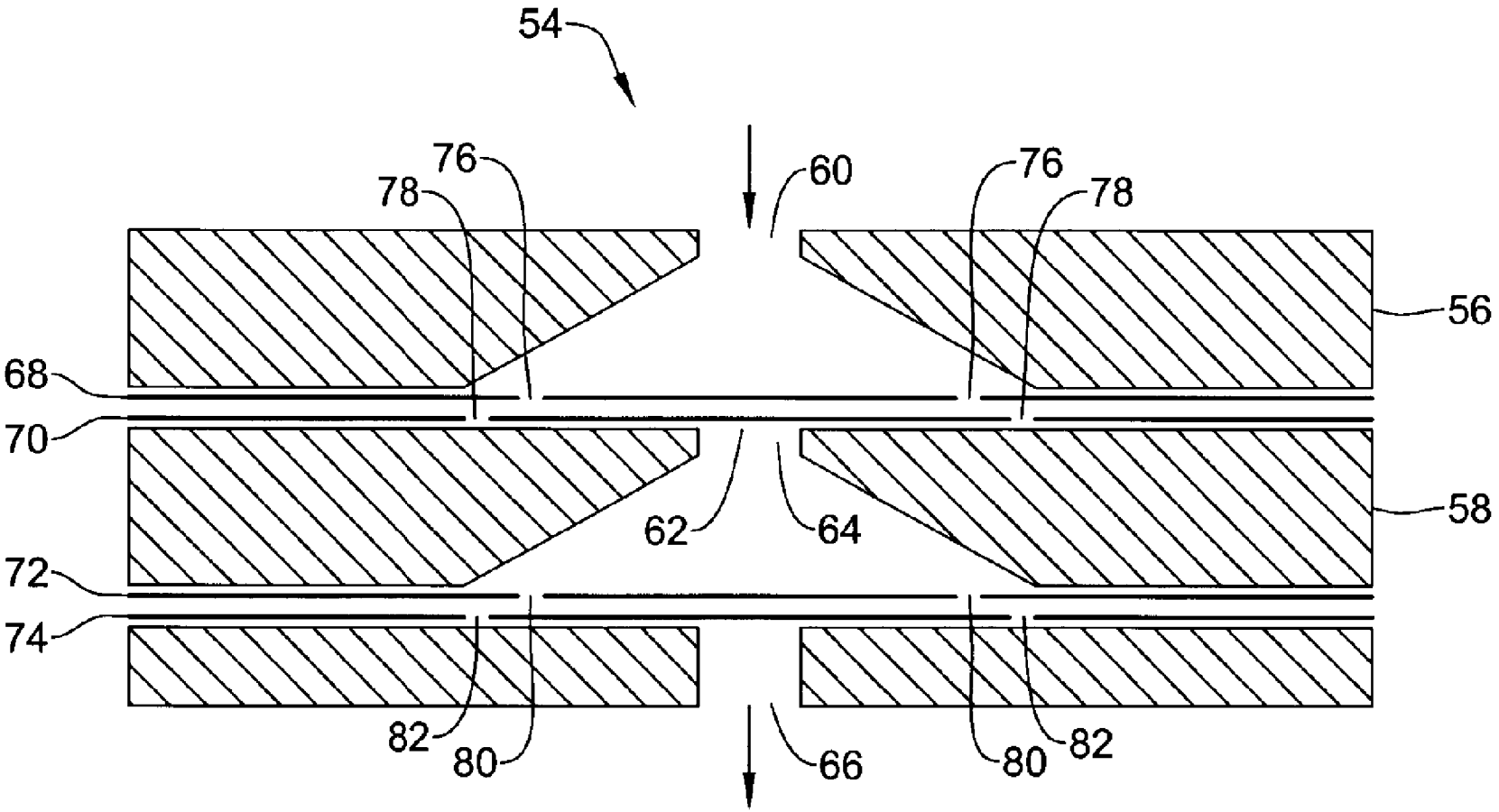
FIG. 10 is a cross-sectional view of a vertical stack micro pump array deploying two asymmetric dual diaphragm micro pumps in accordance with an embodiment of the present invention.

FIG. 10 illustrates a micro pump array 54 that includes an upper micro pump 56 and a lower micro pump 58. It should be noted that designations of upper and lower are arbitrary, as micro pump array 54 can be inverted. In the illustrative embodiment, upper micro pump 56 and lower micro pump 58 may be constructed and function as discussed previously with respect to micro pump 40 (FIG. 3). Upper micro pump 56 includes an inlet 60 and an outlet 62. Lower micro pump 58 includes an inlet 64 and an outlet 66, with the inlet in fluid communication with the outlet 62 of upper micro pump 56.

Upper micro pump 56 includes an upper diaphragm 68 and a lower diaphragm 70, as discussed previously with respect to upper diaphragm 32 and lower diaphragm 34 (FIGS. 2 and 3). Similarly, lower micro pump 58 includes an upper diaphragm 72 and a lower diaphragm 74. Upper diaphragm 68 includes several apertures 76, and lower diaphragm includes several other apertures 78 that are misaligned with apertures 76 of the upper diaphragm 68. Similarly, upper diaphragm 72 includes several apertures 80, while lower diaphragm 74 includes several misaligned apertures 82.

During use, fluid enters inlet 60 and is pumped through to outlet 62 as discussed previously with respect to FIG. 3. The fluid then enters inlet 64 and is pumped through to outlet 66. The fluid pressure increases between inlet 60 and outlet 62, and then increases again between inlet 64 and outlet 66. The total pressure differential across the pump array may be the sum of these fluid pressure increases.

Figure 11:
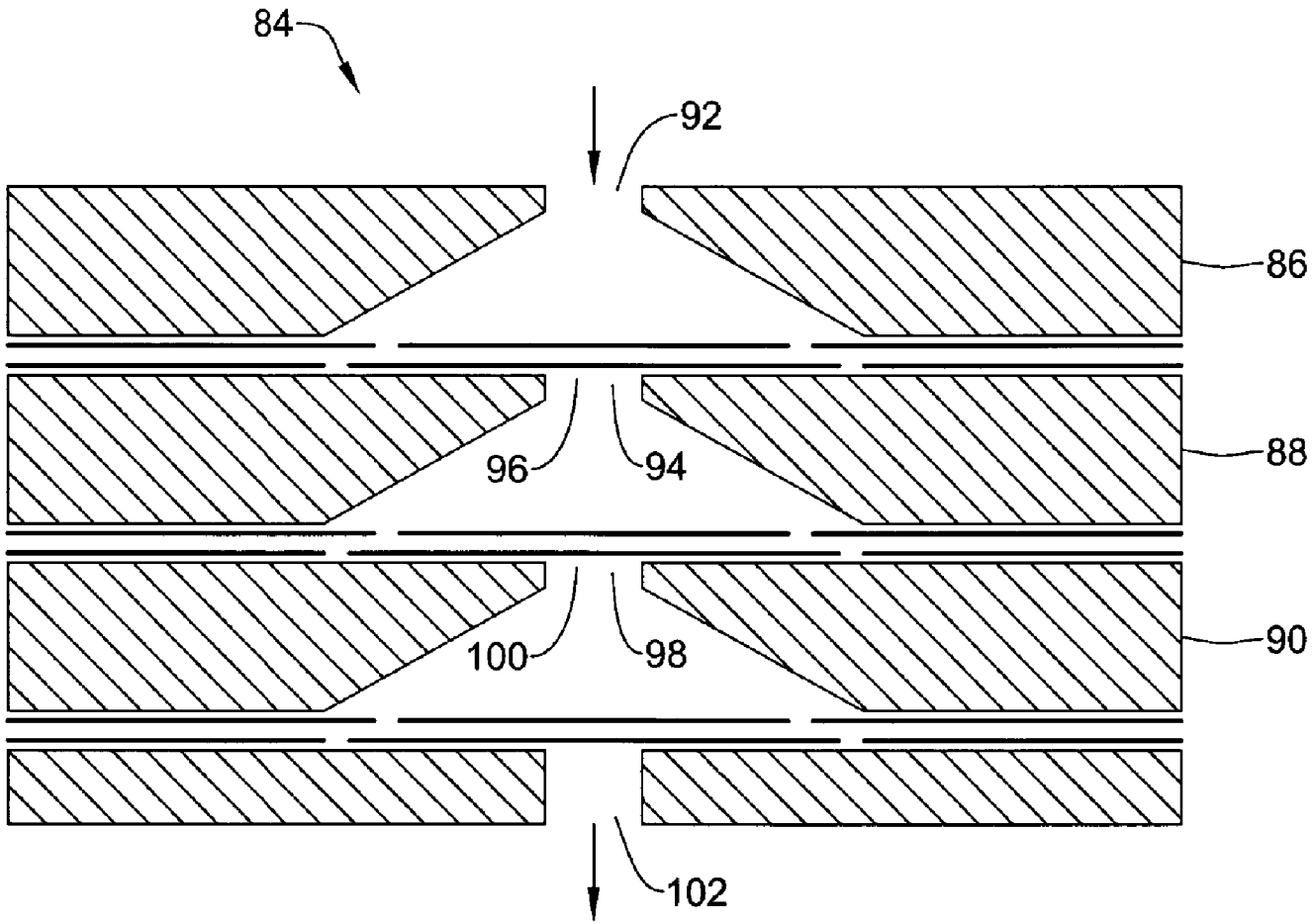
FIG. 11 is a cross-sectional view of a vertical stack micro pump array deploying three asymmetric dual diaphragm micro pumps in accordance with an embodiment of the present invention.

FIG. 11 illustrates a micro pump array 84 that includes an upper micro pump 86, an intermediate micro pump 88 and a lower micro pump 90. Upper micro pump 86 has an inlet 92 and an outlet 94. Intermediate micro pump 88 has an inlet 96 and an outlet 98, where the inlet 96 is in fluid communication with outlet 94 of the upper micro pump 86. Lower micro pump 90 has an inlet 100 and an outlet 102, wherein the inlet 100 is in fluid communication with the outlet 98 of the intermediate micro pump 88. Construction and function of upper micro pump 86, intermediate micro pump 88 and lower micro pump 90 may be the same as described with respect to FIG. 10 and thus is not further discussed in detail here.

During use, fluid enters inlet 92 and is pumped through to outlet 94 as discussed previously with respect to FIG. 10. The fluid then enters inlet 96 and is pumped through to outlet 98. Fluid then enters inlet 100 and is pumped through to outlet 102. As discussed, the fluid pressure may increase as the fluid passes through each of upper micro pump 86, intermediate micro pump 88 and lower micro pump 90. It is contemplated that any number of micro pumps may be stacked in a similar manner to achieve a desired pressure increase.

Figure 12:
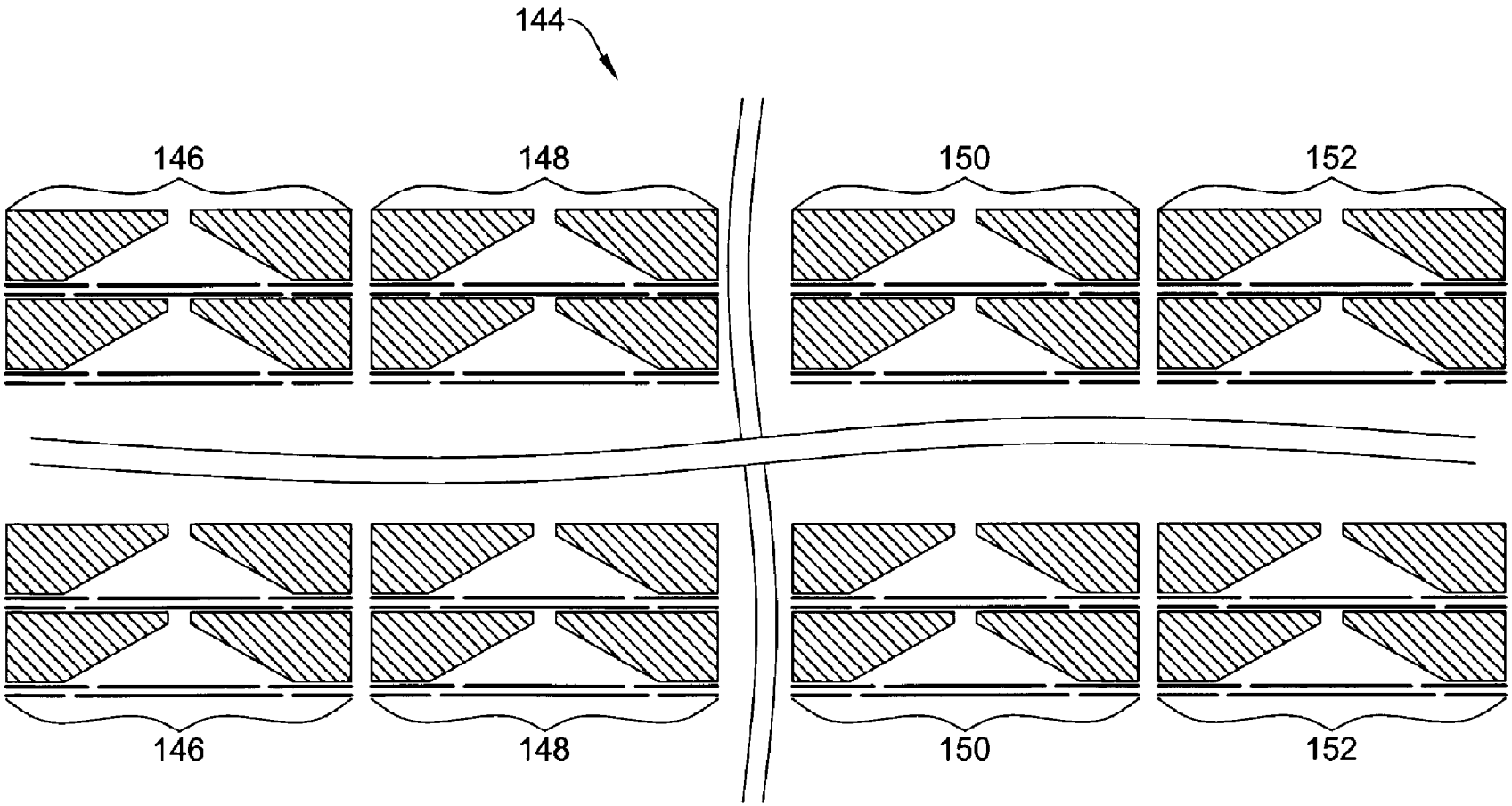
FIG. 12 is a diagrammatic illustration of a massively parallel micro pump array in accordance with an embodiment of the present invention.

FIG. 12 illustrates a micro pump array 144 that includes a number of pumps (such as micro pump 40 of FIG. 3) arranged in series, with two or more series of pumps arranged in parallel. In the illustrative embodiment, micro pump array 144 includes a first micro pump series 146, a second micro pump series 148, a second-to-last micro pump series 150 and a last micro pump series 152. Each of first micro pump series 146, second micro pump series 148, second-to-last micro pump series 150, last micro pump series 152, and each of the intermediate micro pump series (not shown) function as discussed with respect to micro pump array 130 (FIG. 11). By placing a number of micro pump series (or arrays) in parallel, fluid pumping capacity may be increased. Also, by placing a number of micro pumps in parallel, the reliability of the pumping system may be increased because if one or more pump cell fails, others may provide compensation, and/or other unused (redundant) micro-pumps may be activated.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

What is claimed is:

1. A micro pump comprising:

a chamber having a chamber midline;

a first surface including a first portion extending at a first acute angle with respect to the chamber midline;

a second surface opposite the first surface, the second surface including a second portion extending at a second acute angle with respect to the chamber midline;

a first diaphragm disposed within the chamber, at least one first aperture disposed within the first diaphragm; and a second diaphragm disposed within the chamber, at least one second aperture disposed with the second diaphragm;

wherein the second angle is less than the first angle when the first angle and the second angle are measured at a common lateral position along the chamber midline.

2. The micro pump of claim 1, wherein each of the first diaphragm and the second diaphragm are adapted to be electrostatically actuated between a position proximate the first surface and a position proximate the second surface.

3. The micro pump of claim 1, wherein when the first diaphragm and the second diaphragm are situated adjacent to one another, the at least one first aperture disposed within the first diaphragm is/are not aligned with the at least one second aperture disposed within the second diaphragm.

4. The micro pump of claim 1, wherein the first surface further comprises a first port, and the first diaphragm is adapted to be electrostatically actuated to a position in which the first diaphragm seals the first port.

5. The micro pump of claim 1, wherein the second surface further comprises a second port, and the second diaphragm is adapted to be electrostatically actuated to a position in which the second diaphragm seals the second port.

6. The micro pump of claim 1, wherein the second angle is at least about 0.25 degrees less than the first angle.

7. The micro pump of claim 1, wherein the first angle is in the range of about 0.5 to about 5.0 degrees.

8. The micro pump of claim 1, wherein the second angle is less than about 4.75 degrees.

9. The micro pump of claim 1, wherein the second surface is at least substantially parallel with the chamber midline.

10. A vertical stack micro pump array comprising:

a first dual diaphragm chamber comprising:

a first angled upper surface having a first input port;

an opposing first angled lower surface having a first output port, wherein the first angled upper surface is situated at a different relative angle, measured at a common lateral position, than the opposing first angled lower surface; and a first dual diaphragm comprising a first upper diaphragm and a first lower diaphragm; and a second dual diaphragm chamber comprising:

a second angled upper surface having a second input port;

an opposing second angled lower surface having a second output port, wherein the second angled upper surface is situated at a different relative angle, measured at a common lateral position, than the opposing second angled lower surface; and a second dual diaphragm comprising a second upper diaphragm and a second lower diaphragm;

wherein the second input port is in fluid communication with the first output port.

11. The vertical stack micro pump array of claim 10, wherein the first dual diaphragm comprises a first upper diaphragm having an upper first plurality of apertures and a first lower diaphragm having a lower first plurality of apertures misaligned with the upper first plurality of apertures.

12. The vertical stack micro pump array of claim 10, wherein the second dual diaphragm comprises a second upper diaphragm having an upper second plurality of apertures and a second lower diaphragm having a lower second plurality of apertures misaligned with the upper second plurality of apertures.

13. The vertical stack micro pump array of claim 10, further comprising:

a third dual diaphragm chamber comprising:

a third angled upper surface having a third input port;

an opposing third angled lower surface having a third output port, wherein the third angled upper surface is situated at a different relative angle than the opposing third angled lower surface; and a third dual diaphragm comprising a third upper diaphragm and a third lower diaphragm;

wherein the third input port is in fluid communication with the second output port.

14. The vertical stack micro pump array of claim 10 wherein the first dual diaphragm chamber includes a chamber midline, and the first angled upper surface is situated at a first angle relative to the chamber midline and the opposing first angled lower surface is situated at a second angle relative to the chamber midline, wherein the first angle is different from the second angle.

15. The vertical stack micro pump of claim 14, wherein the second angle is zero or substantially zero.

16. The vertical stack micro pump array of claim 10, further comprising another vertical stack micro pump situated in a parallel relationship.

* * * * *